US008241087B1

(12) United States Patent
Bowser

(10) Patent No.: US 8,241,087 B1
(45) Date of Patent: Aug. 14, 2012

(54) CHILD TOY ASSEMBLY

(76) Inventor: Lori S. Bowser, Drums, PA (US)

( * ) Notice: Subject to any disclaimer, the term of this patent is extended or adjusted under 35 U.S.C. 154(b) by 560 days.

(21) Appl. No.: 12/544,749

(22) Filed: Aug. 20, 2009

(51) Int. Cl.
*A63H 33/22* (2006.01)

(52) U.S. Cl. ..... 446/485

(58) Field of Classification Search ..... 446/485, 446/484, 227, 219, 438, 26, 28, 71, 72, 175, 446/297, 404; 24/3.11
See application file for complete search history.

(56) References Cited

U.S. PATENT DOCUMENTS

| | | | | |
|---|---|---|---|---|
| 2,633,668 | A | 4/1953 | Schaefer | |
| 2,726,483 | A * | 12/1955 | Hughes et al. | 446/242 |
| D271,406 | S | 11/1983 | Osborne | |
| 6,026,546 | A * | 2/2000 | Lund et al. | 24/431 |
| D450,791 | S | 11/2001 | Grimm et al. | |
| 6,393,668 | B1 * | 5/2002 | Olson et al. | 24/67 R |
| D464,685 | S | 10/2002 | Weiser et al. | |
| 6,475,057 | B1 | 11/2002 | Norman | |
| 6,558,224 | B2 * | 5/2003 | Chan | 446/219 |
| D477,987 | S * | 8/2003 | Adams et al. | D8/395 |
| 6,607,388 | B2 | 8/2003 | Cogliano | |
| 6,860,786 | B2 | 3/2005 | Oren et al. | |
| D505,290 | S | 5/2005 | Bourget | |
| D526,927 | S | 8/2006 | Weiser | |
| 7,086,121 | B2 * | 8/2006 | Lippincott | 24/3.13 |
| 2006/0105671 | A1 * | 5/2006 | Connolly | 446/485 |
| 2006/0194508 | A1 * | 8/2006 | Johnson et al. | 446/485 |
| 2007/0251268 | A1 * | 11/2007 | Gisser et al. | 63/1.11 |

* cited by examiner

*Primary Examiner* — Gene Kim
*Assistant Examiner* — Amir Klayman

(57) ABSTRACT

A child toy assembly includes a housing that resembles an insect and has a front portion forming a head. A control circuit is mounted within the housing. A low intensity light emitter is mounted within the head and illuminates the head when the low intensity light emitter is turned on. The low intensity light emitter is electrically coupled to the control circuit and is actuated by a low light actuator. A high intensity light emitter is mounted within the housing opposite of the head. A rear portion of the housing opposite the head is transparent. The high intensity light emitter emits light outwardly through the rear portion. The high intensity light emitter is electrically coupled to the control circuit and is actuated by a high light actuator. A coupling apparatus is attached to the housing and attaches the housing to an object in close proximity to a child.

1 Claim, 7 Drawing Sheets

CHILD TOY ASSEMBLY

BACKGROUND OF THE DISCLOSURE

Field of the Disclosure

The disclosure relates to child toy devices and more particularly pertains to a new child toy device for entertaining a child and which can be mounted adjacent to an object containing the child.

SUMMARY OF THE DISCLOSURE

An embodiment of the disclosure meets the needs presented above by generally comprising a housing that has a bottom wall, a top wall and a perimeter wall extending between the top and bottom walls. The housing resembles an insect and has a front portion forming a head. A control circuit is mounted within the housing. A power source is mounted in the housing and is electrically coupled to the control circuit. A low intensity light emitter is mounted within the head. The low intensity light emitter illuminates the head when the low intensity light emitter is turned on. The low intensity light emitter is electrically coupled to the control circuit. A low light actuator is mounted on the housing and is electrically coupled to the control circuit. The low intensity light is turned on or off when the low light actuator is actuated. A high intensity light emitter is mounted within the housing opposite of the head. A rear portion of the housing opposite the head is transparent. The high intensity light emitter emits light outwardly through the rear portion when the high intensity light emitter is turned on. The high intensity light emitter is electrically coupled to the control circuit. A high light actuator is mounted on the housing and is electrically coupled to the control circuit. The high intensity light is turned on or off when the high light actuator is actuated. A coupling apparatus is attached to the housing to allow the housing to be attachable to an object in close proximity to a child.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
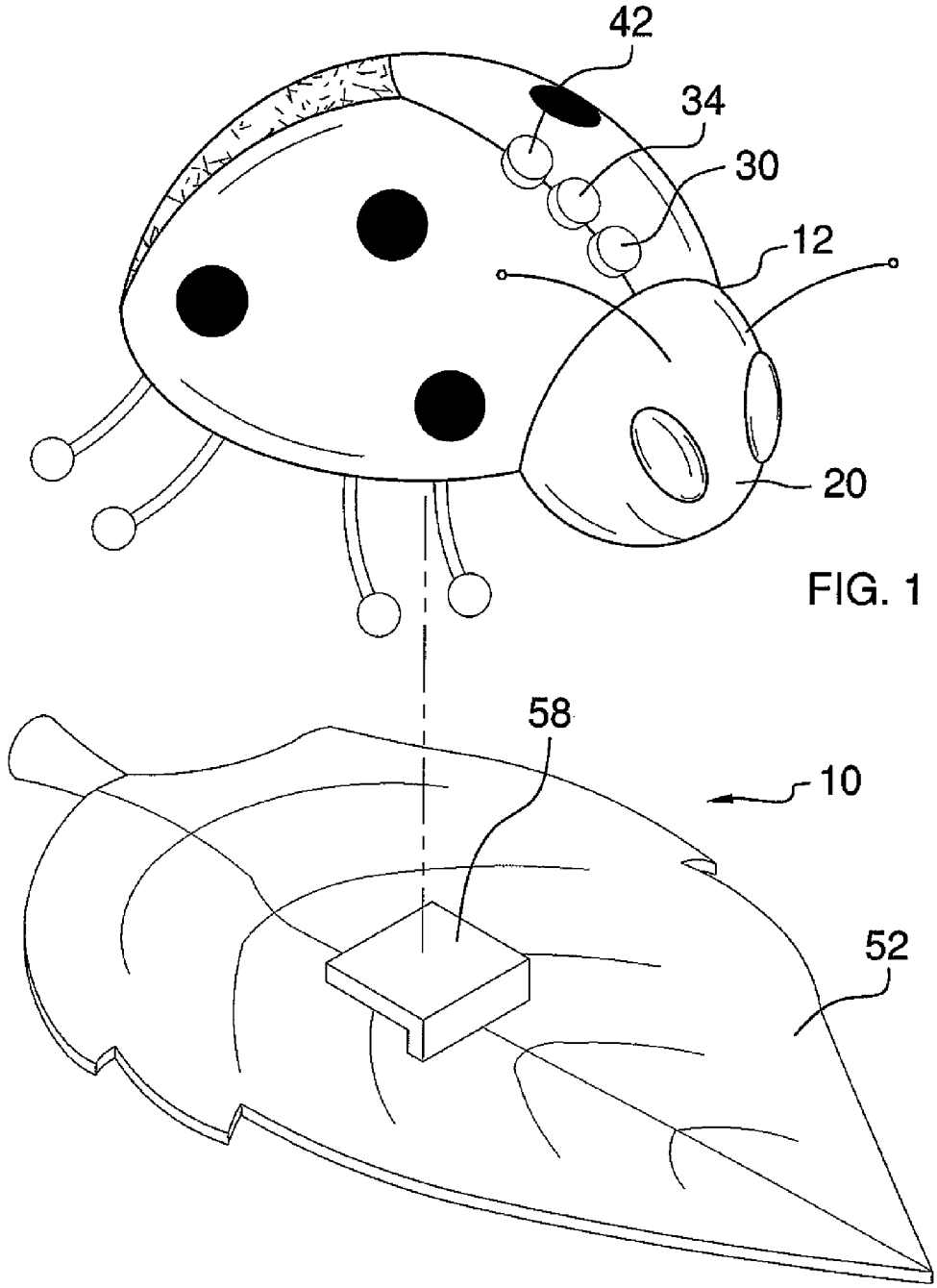
FIG. 1 is a front perspective view of a child toy assembly according to an embodiment of the disclosure.
Figure 2:
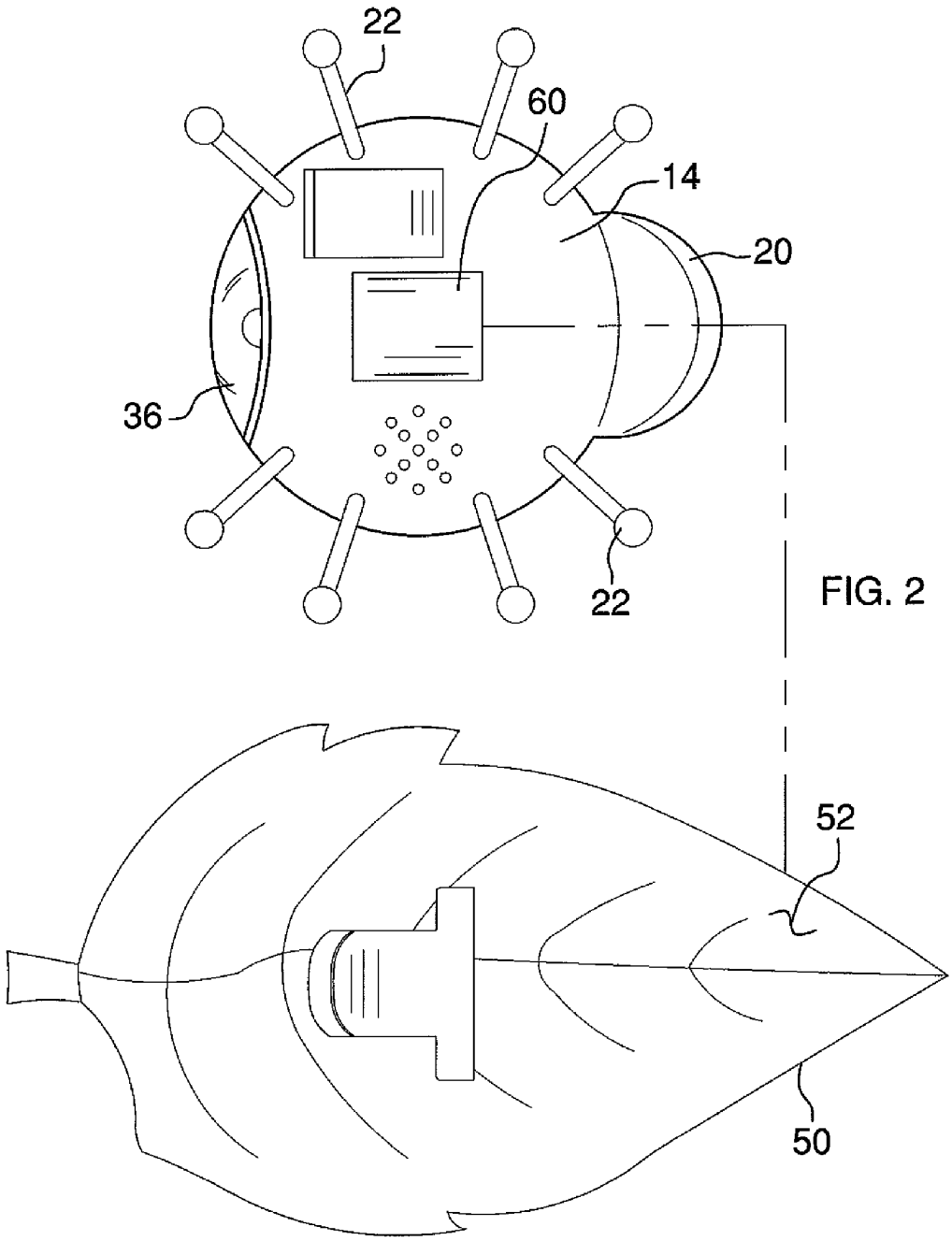
FIG. 2 is a bottom view of a housing and a plate an embodiment of the disclosure.

With reference now to the drawings, and in particular to FIGS. 1 through 8 thereof, a new child toy device embodying the principles and concepts of an embodiment of the disclosure and generally designated by the reference numeral 10 will be described.

Figure 3:
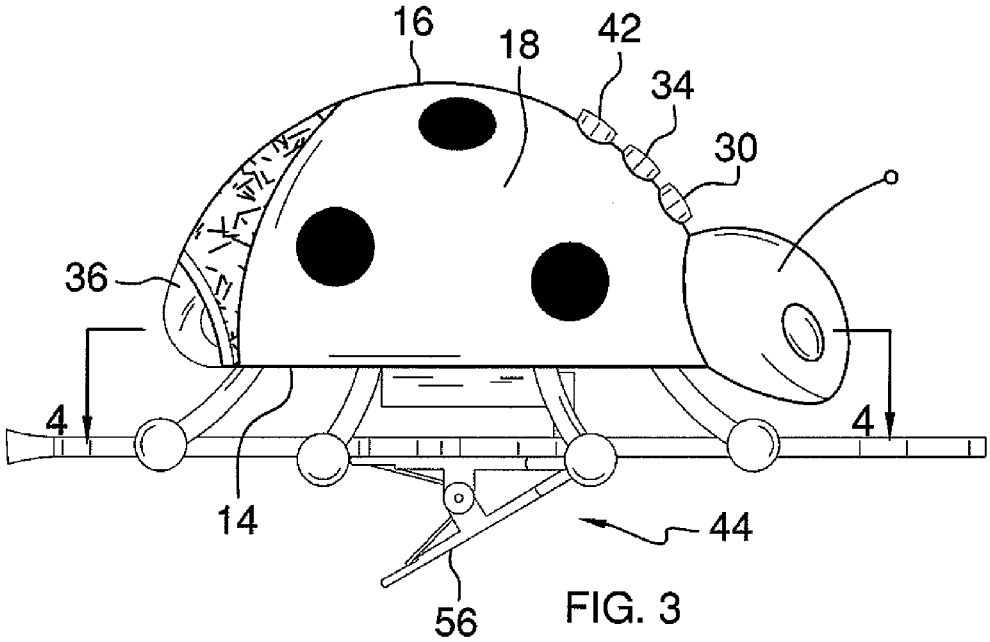
FIG. 3 is a side view of an embodiment of the disclosure.
Figure 4:
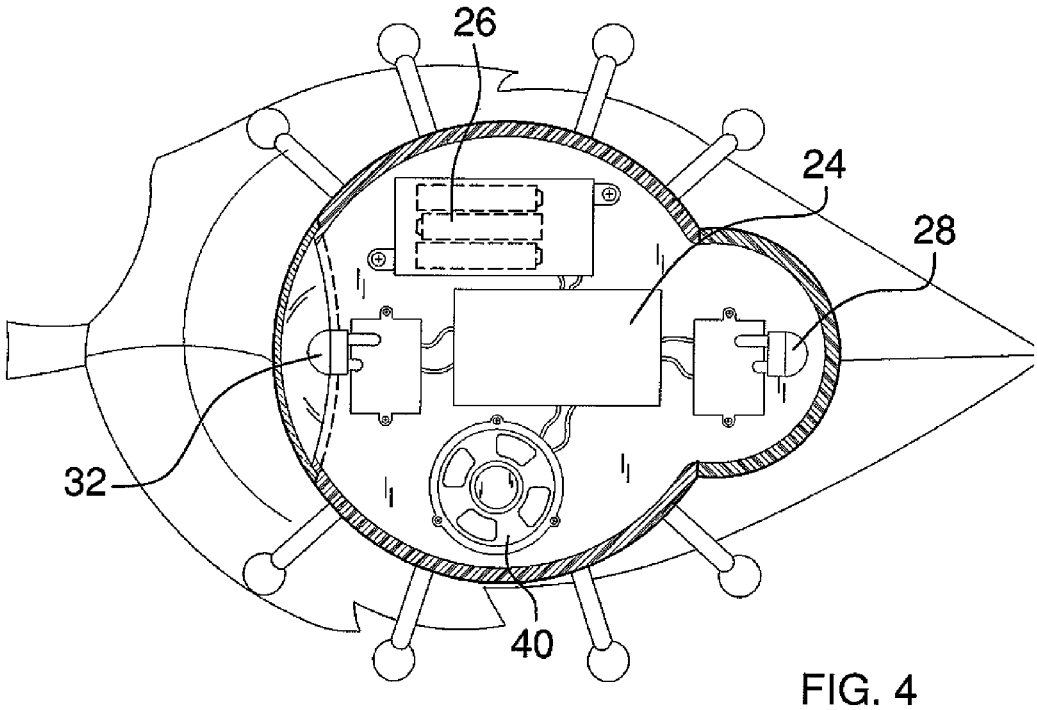
FIG. 4 is a cross-sectional view taken along line 4-4 of FIG. 3 of an embodiment of the disclosure.
Figure 5:
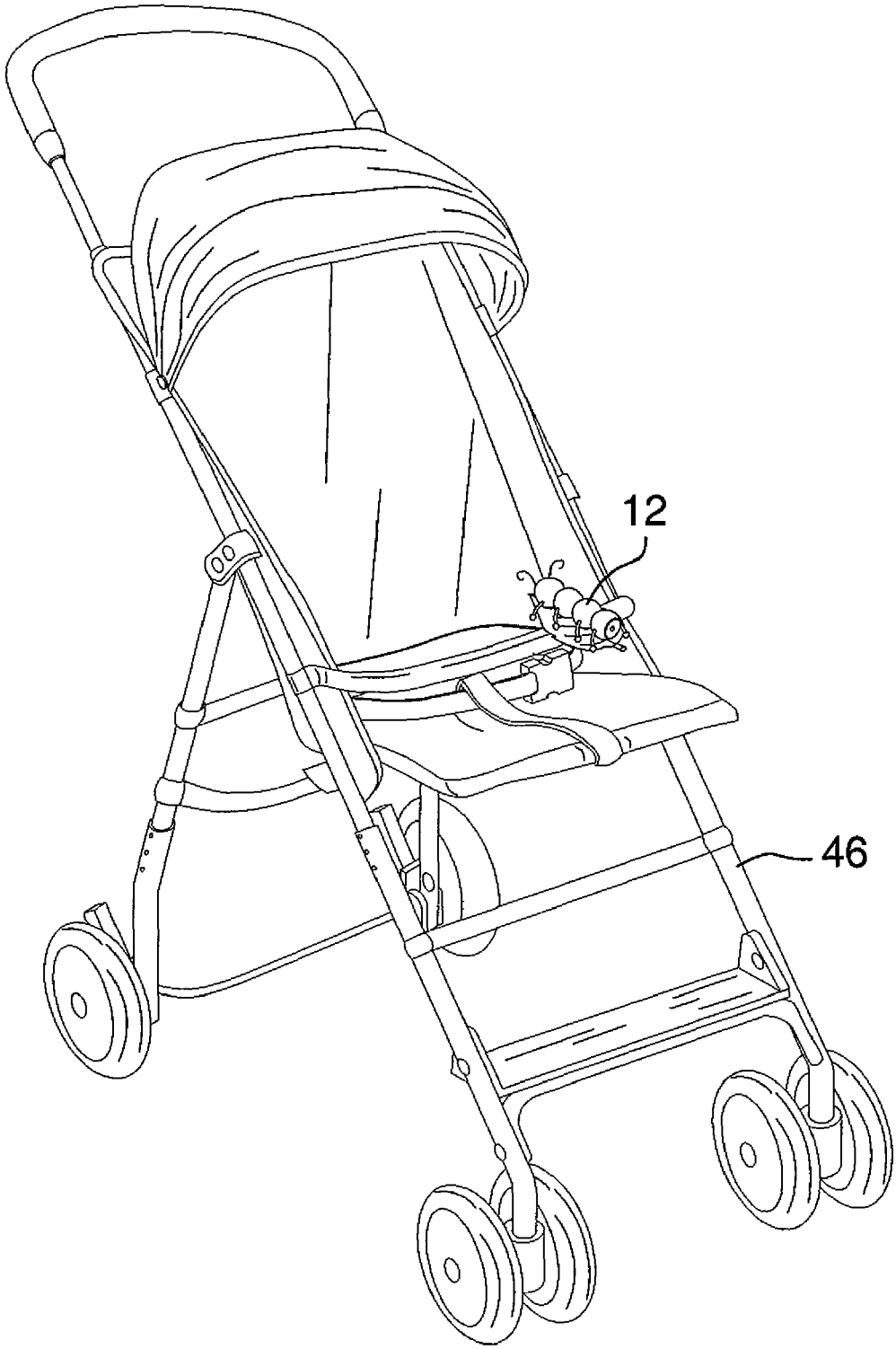
FIG. 5 is a rear perspective in-use view of an embodiment of the disclosure.
Figure 6:
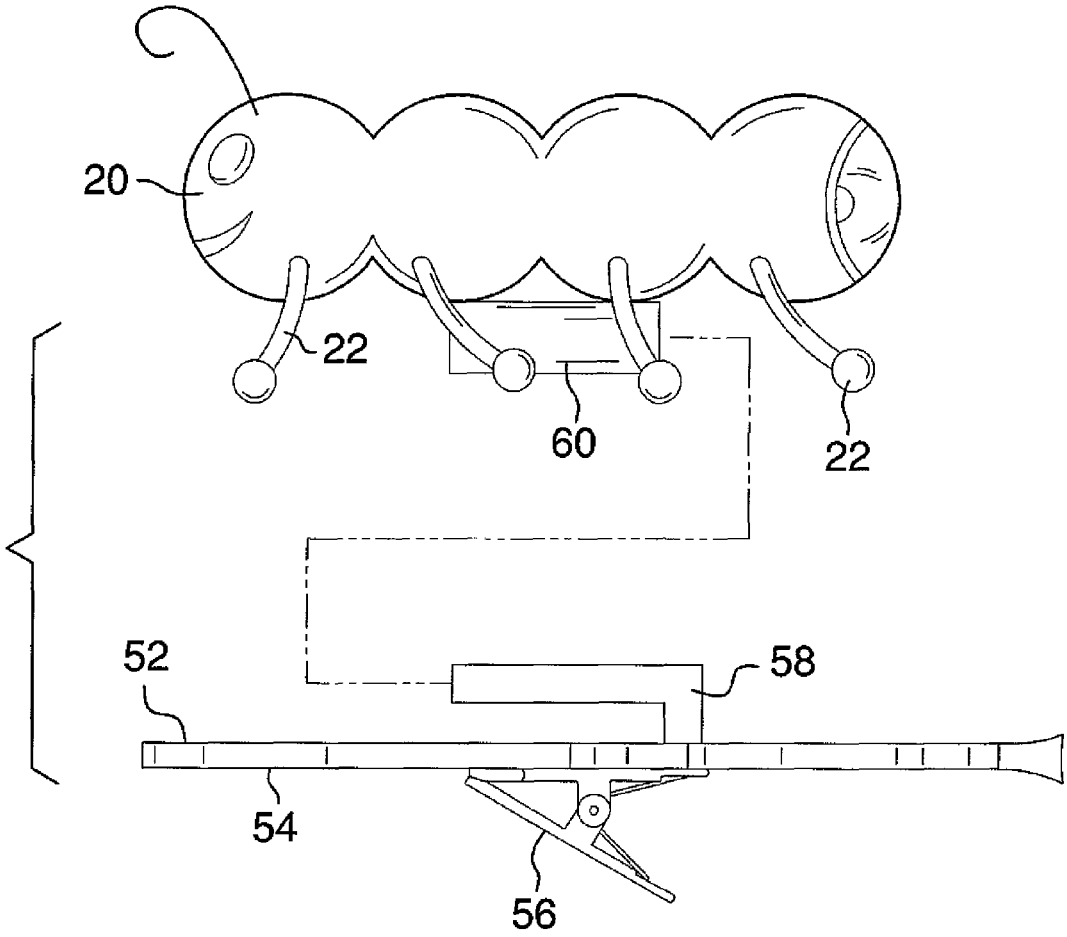
FIG. 6 is a side view of an embodiment of the disclosure.
Figure 7:
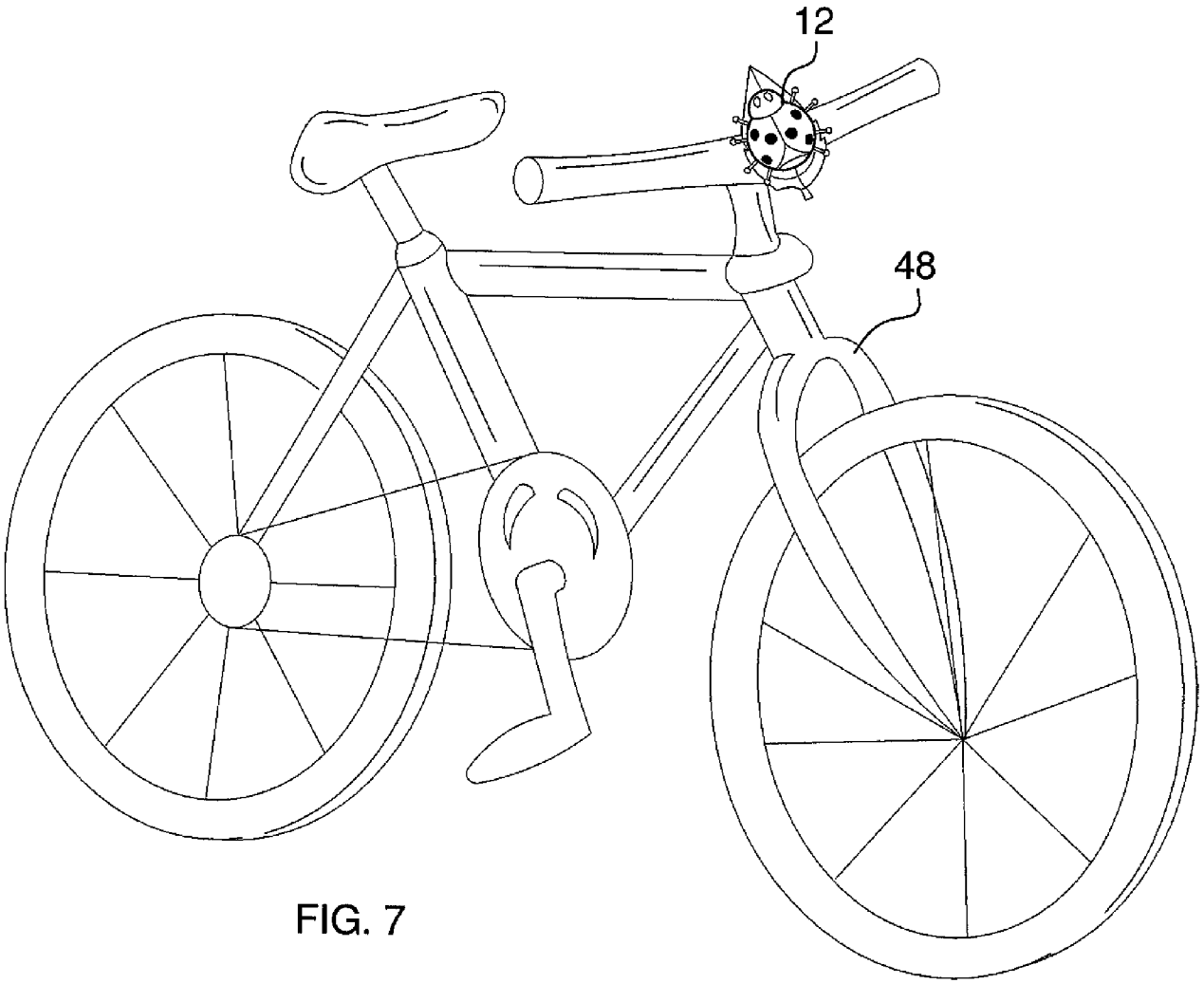
FIG. 7 is a perspective in-use view of an embodiment of the disclosure.
Figure 8:
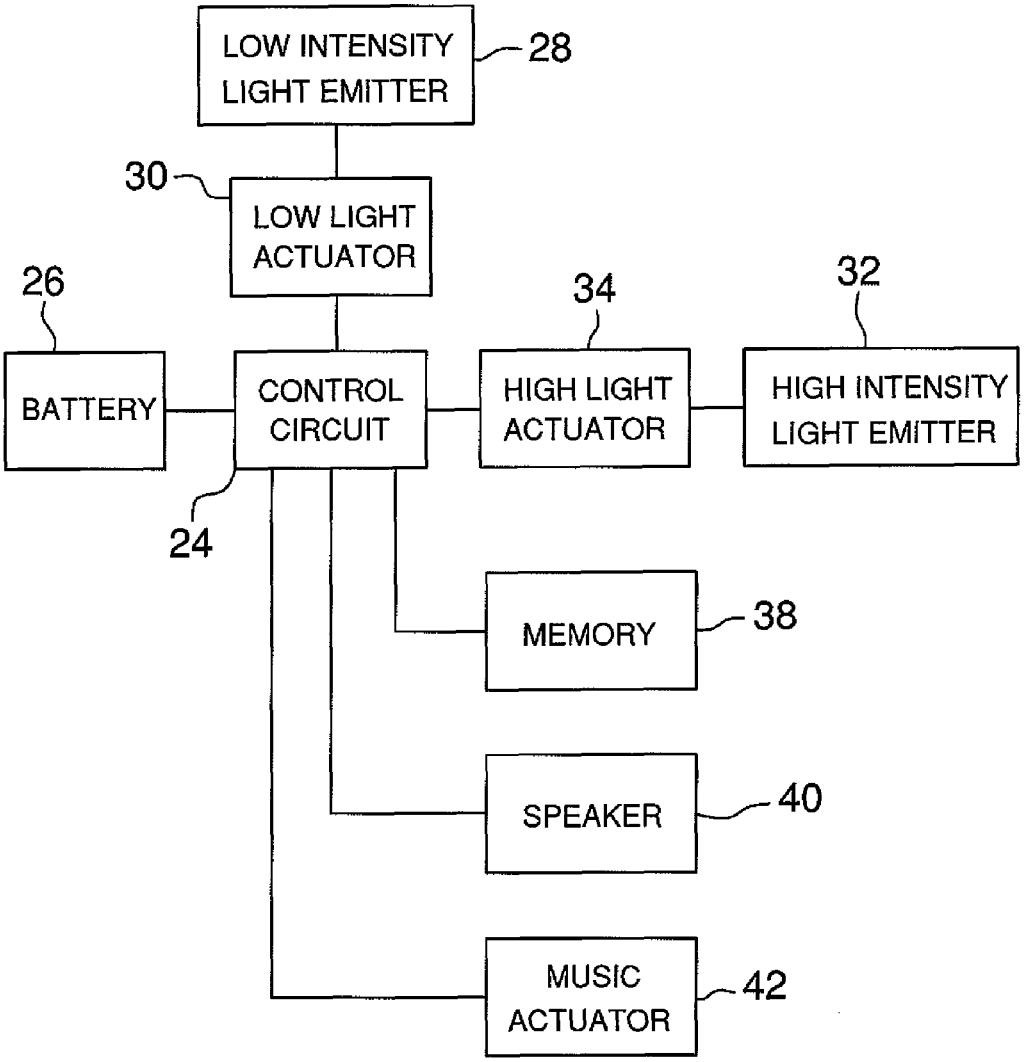
FIG. 8 is a schematic view of an embodiment of the disclosure.

As best illustrated in FIGS. 1 through 8, the child toy assembly 10 generally comprises a housing 12 that has a bottom wall 14, a top wall 16 and a perimeter wall 18 extending between the top 16 and bottom 14 walls. The housing 12 resembles an insect and has a front portion forming a head 20. FIGS. 3 and 6 depict two different insect shapes that may be used. A plurality of legs 22 is attached to and extends downwardly from the housing 12. The legs 22 stabilize the housing 12 when a coupling apparatus described below is not used.

A control circuit 24 is mounted within the housing 12. A power source 26, such as one or more batteries, is mounted in the housing 12 and is electrically coupled to the control circuit 24. A low intensity light emitter 28 is mounted within the head 20. The low intensity light emitter 28 illuminates the head 20 when the low intensity light emitter 28 is turned on. The low intensity light emitter 28 is electrically coupled to the control circuit 24. The head 20 may be comprised of a translucent, but not transparent, material so that head 20 glows when the low intensity light emitter 28 is turned on. A low light actuator 30 is mounted on the housing 12 and is electrically coupled to the control circuit 24. The low intensity light emitter 28 is turned on or off when the low light actuator 30 is actuated.

A high intensity light emitter 32 is mounted within the housing 12 opposite of the head 20. The high intensity light emitter 32 is simply "high intensity" with respect to the low intensity light emitter 28 in that it will emit more light overall and will emit more light from the housing. However, each of the low 28 and high 32 intensity light emitters will likely comprise light emitting diodes. High intensity light may also be accomplished by utilizing multiple light emitters in place of a single high intensity light emitter. A rear portion 36 of the housing 12 opposite the head 20 is transparent. The high intensity light emitter 32 emits light outwardly through the rear portion 36 when the high intensity light emitter 32 is turned on. The high intensity light emitter 32 is electrically coupled to the control circuit 24. A high light actuator 34 is mounted on the housing 12 and is electrically coupled to the control circuit 24. The high intensity light emitter 32 is turned on or off when the high light actuator 34 is actuated.

An electronic memory 38 is mounted within the housing 12 and is electrically coupled to the control circuit 24. At least one melody is stored on the electronic memory 38. A sound emitter 40 is mounted to the housing 12 and is electrically coupled to the control circuit 24. The sound emitter 40 audibly emits the at least one the melody when the control circuit 24 accesses the at least one the melody from the electronic memory 38. A music actuator 42 is mounted on the housing and is electrically coupled to the control circuit. The music actuator 42 actuates the control logic 24 to access the at least one melody and audibly play the at least one melody when the music actuator 42 is actuated. If the electronic memory 38 includes more that one melody, the control circuit 24 may be programmed to either cycle through or randomly select one of the melodies to play. Such music playing means are conventional to children's toys which just play music.

A coupling apparatus 44 is attached to the housing 12 to allow the housing 12 to be attachable to an object in close proximity to a child. The object may be a stroller 46, bicycle 48, crib or the like. The coupling apparatus 44 includes a plate 50 that has a first side 52 and a second side 54. The plate 50 may have a shape resembling a leaf. A clip 56 is attached to the second side 54. The clip 56 is a spring biasing clip that is clippable to the object. A first mating member 58 is attached to the first side 52 of the plate 50. A second mating member 60 is attached to the bottom wall and is removably coupled to the first mating member 58 to attach the housing to the plate 50. The second mating member 60 may comprise a sleeve that receives and is frictionally engageable with the first mating member 58. The first 58 and second 60 mating members allow a user to replace the housing 12 with a different housing having a different shape.

In use, the low intensity light emitter 28 may be used for as a small nightlight or simply to entertain the child. The high intensity light emitter 32 may also be used as a nightlight but can also be used to direct light in a particular direction, while the sound emitter 40 can be used to emit soothing melodies for the child. The coupling apparatus 44 allows the assembly 10 to be attached to items such as strollers, cribs and the like so that the assembly 10 is easily accessible by the child.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A toy assembly for a child comprising:

a housing having a bottom wall, a top wall and a perimeter wall extending between said top and bottom walls, said housing resembling an insect and having a front portion forming a head, a plurality of legs being attached to and extending downwardly from said housing;

a control circuit being mounted within said housing, a power source being mounted in said housing and being electrically coupled to said control circuit;

a low intensity light emitter being mounted within said head, said low intensity light emitter illuminating said head when said low intensity light emitter is turned on, said low intensity light emitter being electrically coupled to said control circuit;

a low light actuator being mounted on said housing and being electrically coupled to said control circuit, said low intensity light being turned on or off when said low light actuator is actuated;

a high intensity light emitter being mounted within said housing opposite of said head, a rear portion of said housing opposite said head being transparent, said high intensity light emitter emitting light outwardly through said rear portion when said high intensity light emitter is turned on, said high intensity light emitter being electrically coupled to said control circuit;

a high light actuator being mounted on said housing and being electrically coupled to said control circuit, said high intensity light being turned on or off when said high light actuator is actuated;

an electronic memory being mounted within said housing and being electrically coupled to said control circuit, at least one melody being stored on said electronic memory;

a sound emitter being mounted to said housing and being electrically coupled to said control circuit, said sound emitter emitting said at least one said melody when said control circuit accesses said at least one said melody from said electronic memory;

a music actuator being mounted on said housing and being electrically coupled to said control circuit, said music actuator actuating said control logic to access said at least one melody and audibly play said at least one melody when said music actuator is actuated; and a coupling apparatus being attached to said housing to allow said housing to be attachable to an object in close proximity to a child, said coupling apparatus including;

a plate having a first side and a second side, said plate having a shape resembling a leaf;

a clip being attached to said second side, said clip being clippable to the object;

a first mating member being attached to said first side of said plate;

a second mating member being attached to said bottom wall and being removably coupled to said first mating member to attach said housing to said plate.

* * * * *